US006486903B1

(12) United States Patent
Wagner et al.

(10) Patent No.: US 6,486,903 B1
(45) Date of Patent: Nov. 26, 2002

(54) TRANSFER PRINTING PROCESS

(75) Inventors: Barbara Wagner, Mt. Pleasant, SC (US); Ming Xu, Mt. Pleasant, SC (US)

(73) Assignee: Sawgrass Systems, Inc., Mt. Pleasant, SC (US)

( * ) Notice: Subject to any disclaimer, the term of this patent is extended or adjusted under 35 U.S.C. 154(b) by 0 days.

(21) Appl. No.: 09/670,674

(22) Filed: Sep. 27, 2000

(51) Int. Cl.[7] ..... B41J 2/315
(52) U.S. Cl. ..... 347/212
(58) Field of Search ..... 347/212, 88; 396/575; 358/406; 400/207, 120.01, 120.02, 240, 241.1; 156/230, 240, 583.1; 8/471; 346/76.1; 101/487, 488

(56) References Cited

U.S. PATENT DOCUMENTS

| | | | | |
|---|---|---|---|---|
| 4,058,644 A | | 11/1977 | DeVries et al. | |
| 4,619,665 A | | 10/1986 | Sideman et al. | |
| 4,773,953 A | | 9/1988 | Hare | |
| 4,880,324 A | * | 11/1989 | Sato et al. | 400/241 |
| 5,047,556 A | | 9/1991 | Kohler et al. | |
| 5,453,451 A | | 9/1995 | Sokol | |
| 5,601,023 A | | 2/1997 | Hale et al. | |
| 5,935,661 A | | 8/1999 | Biller et al. | |
| 6,017,593 A | | 1/2000 | Daly et al. | |
| 6,017,640 A | | 1/2000 | Muthiah et al. | |
| 6,034,788 A | * | 3/2000 | Sasanuma et al. | 358/406 |
| 6,103,041 A | | 8/2000 | Thompson et al. | |
| 6,105,502 A | | 8/2000 | Wagner et al. | |
| 6,155,726 A | * | 12/2000 | Ishikawa et al. | 396/575 |
| 6,164,851 A | * | 12/2000 | Sakamoto et al. | 400/207 |

* cited by examiner

*Primary Examiner*—John Barlow
*Assistant Examiner*—K. Feggins
(74) *Attorney, Agent, or Firm*—B. Craig Killough

(57) ABSTRACT

A coated media is printed with ink. The area of the media which is not covered with ink is cured by exposure to radiation, and the printed image is transferred to a final substrate. The media is coated with a radiation curable coating. Upon exposure to electron beam or ultraviolet radiation, the coating in the exposed, non-imaged, area cures, and becomes permanently bonded to the base sheet. The ink layer of the imaged area effectively blocks, absorbs and/or reflects the radiation and does not allow polymerization under the imaged area. The image is transferred to a final substrate by placing the image in contact with the final substrate, followed by the application of energy. The image is permanently bonded to the final substrate. No overprint, or non-imaged area, that is visible or which may be felt by touching, is transferred to the final substrate.

10 Claims, 3 Drawing Sheets

TRANSFER PRINTING PROCESS

FIELD OF THE INVENTION

This invention is related to digital printing generally, and is more specifically related to a transfer printing process using an ink which is curable by ultraviolet radiation.

BACKGROUND OF THE INVENTION

Transfer processes involve physically transferring an image from one substrate to another and can be achieved in several ways. One method is melt transfer printing where a design is first printed on paper using a waxy ink. Melt transfer printing has been used since the nineteenth century to transfer embroidery designs to fabric. A design is printed on paper using a waxy ink, then transferred with heat and pressure to a final substrate. The Star process, developed by Star Stampa Artistici di Milano, uses a paper that is coated with waxes and dispersing agents. The design is printed onto the coated paper by a gravure printing process using an oil and wax based ink. The print is then transferred to fabric by pressing the composite between heated calendar rollers at high pressure. The ink melts onto the final substrate carrying the coloring materials with it. Fabrics printed in such a method using direct dyes are then nip-padded with a salt solution and steamed. Vat dyes can also be used in the ink, but the fabric must be impregnated with sodium hydroxide and hydrous solution and steamed. The residual waxes from the transfer ink are removed during washing of the fabric.

Another method of transfer printing is film release transfer. Here the image is printed onto a paper substrate coated with a film of heat tackifiable resin. Upon application of heat and pressure to the backside of the image, the entire film containing the image is transferred to the final substrate. A process of thermal transfer wherein the ink physically bonds to the substrate is described in, for example, Hare, U.S. Pat. No. 4,773,953. The resulting image, as transferred, is a surface bonded image with a raised, plastic-like feel to the touch. Thermal transfer paper can transfer an image to a final substrate, such as cotton, however, this method has several limitations. First, the entire sheet is transferred, not just the image. Second, such papers are heavily coated with polymeric material to bind the image onto the textile. This material makes the transfer area very stiff and has poor dimensional stability when stretched.

Another method of transfer employs the use of heat activated, or sublimation, dyes. One form of an appropriate transfer process using sublimation inks is described in Hale, et. al., U.S. Pat. No. 5,601,023, the teachings of which are incorporated herein by reference. In this situation, an image is printed onto an intermediate medium, such as paper, followed by application of heat and pressure to the backside of the intermediate medium while in contact with a final substrate. The dyes then vaporize and are preferentially absorbed by the final substrate. Sublimation dyes yield excellent results when a polyester substrate is used and are highly resistant to fading and abrasion caused by laundering. These dyes, however, have a limited affinity for substrates other than polyester, and give poor results on natural fibers such as cotton and wool.

A method of preparing an image-receiving sheet for sublimation transfer utilizing isocyanate groups is described in DeVries, U.S. Pat. No. 4,058,644. Here, a polyisocyanate is reacted with a polyol to form a polyurethane containing free or blocked isocyanate groups. A print paste containing this polymer along with a sublimation dye is coated onto a paper substrate via roller coating, brush coating, silk screening, or similar method. The image may then be heat transferred to a cotton substrate. The application of heat to the backside of the printed image activates the sublimation dye as well as the blocked isocyanate groups. The isocyanate groups become unblocked at the transfer temperature and available to react with hydroxyl groups on the cellulose fibers, therefore forming a chemical bond with the cellulose fiber.

One method of transferring only a portion of a printed image is described in Sideman, et. al., U.S. Pat. No. 4,619,665. Here a sheet is first layered with a mixture of reactive and non-reactive sublimation dyes. Polyethyleneimines, which react with the reactive sublimation dyes, are then deposited on the dyes in a pattern via conventional printing techniques such as gravure or flexographic printing. The structure and the substrate to be printed are placed in contact with each other, and upon heating, only the dyes in the areas not printed with the polyethyleneimines and the non-reactive dyes under or mixed with the thus printed polyethyleneimines are sublimed to the final substrate. The reactive sublimation dyes are blocked from sublimating by reaction with the polyethyleneimines.

The use of photopolymerizable materials to form durable coatings is well known. Photochemically produced polymerization reactions have become increasingly important for rapid curing of thin films in such areas as the curing of paint and plastic coatings on paper, metal and wood, and in the drying of printing inks. The photopolymerizable coating is a coating that is deposited on a substrate, and subsequently cured to form a final coating that is firmly affixed to the substrate. The curing step is performed by exposure of the coating to some form of radiation. In a typical application, UV radiation is the method of curing. UV radiation is sufficiently energetic to initiate certain chemical reactions when a photoinitiator is present, but electromagnetic radiation more energetic may be used. In addition, exposure to electron beams may be used to initiate polymerization of a coating.

The process of photopolymerization involves first absorption of incident radiation by an absorbing molecule within the chemical system. The absorbing molecule may be a photosensitizer or a photoinitiator. A photosensitizer is not consumed in subsequent chemical reactions, but rather acts as a photocatalyst by transferring internal energy to another molecule, which then initiates the polymerization reaction. By transferring its internal energy, the photosensitizer is returned to its original state. A photoinitiator is consumed in the polymerization reaction. The photoinitiator is excited, ionized or fragmented by incident radiation, then initiates polymerization. "Photoinitiator" can, however, be used in general terms to mean any species which interacts with the incident radiation.

A coating may contain monomers and/or oligomers, along with the photoinitiators and other additives. After application to the substrate, the curing step involves polymerization of the coating to form the final cured coating on the substrate. UV curable coatings applied as a liquid are typically solutions of monomers. Coatings applied as solids are frequently partially polymerized prior to application to the substrate. The partially polymerized polymers are known as oligomers or prepolymers. The curing of the solid coating on the substrate then involves polymerization of the remaining functionality to form the final coating. Often a coating formulation will comprise a mixture of both monomers and oligomers.

There are two general classes of polymerization of primary concern, cationic and free radical systems. In cationic cure systems, positively charged species are the primary mechanism for curing the polymer. Epoxy resins are the most common chemical species used for this type of cure. In free radical systems, a free radical is the chemical species responsible for the curing reactions. Common resins of this type include acrylates, unsaturated polyesters, polyene/thiol systems, maleates and vinyl/acrylics, among others.

Pigments attenuate light by absorption and/or altering the direction of propagation through scattering and/or reflection. Thus, opaque pigments inherently reflect, absorb or otherwise interfere with the transmittance of ultraviolet light through a pigmented ink or coating, and, consequently, impede the penetration of the UV radiation into the lower layers of a pigmented film during curing. Opacity and color strength are, as a rule, desirable properties for inks and coatings. Full cure of UV curable inks and pigmented coatings is difficult because the pigments impede the penetration of radiation. A number of patents have been written to describe processes and formulations for improving the cure of these inks and pigmented coatings, for example, such as described by Muthiah, et. al. in U.S. Pat. No. 6,017,640. Here dual thermal and UV curable ingredients are incorporated into an opaquely pigmented powder coating formulation in order to fully cure through the entire thickness of a film. In U.S. Pat. No. 5,047,556, Kohler, et. al. describe the problem of curing pigmented systems that absorb a large proportion of the active wavelength so that higher concentrations of photoinitiators and/or sensitizers must be used. In order to help overcome this, photoinitiators which combine two basic structural types were developed in order to absorb UV wavelengths in a wider "absorption window".

SUMMARY OF THE INVENTION

The present invention relates to a method of transfer printing. A coated media is printed with ink, the area of the media which is not covered with ink is cured by exposure to ultraviolet radiation, and the printed image is transferred to a final substrate.

The media is coated with a radiation curable, including electron beam or UV curable, coating. Upon exposure to electron beam or ultraviolet radiation, the coating in the exposed, non-imaged area cures, and becomes permanently bonded to the base sheet. The ink in the imaged area effectively blocks, absorbs and/or reflects the radiation, and does not allow polymerization under the imaged area. The image is then transferred to a final substrate by placing the image printed on the media in contact with the final substrate, followed by the application of energy, for example radiation, or heat and/or pressure. In this way, the image is permanently bonded to the final substrate, while no overprint, or non-imaged area, that may be visible and/or felt is transferred to the final substrate.

It is an object of the present invention to provide a media containing a radiation curable coating. It is another object of the invention to provide a radiation curable coating that receives a printed image. It is a further object of the invention to provide an image formed from an ink containing reactive ingredients that crosslink during the transfer step to form a permanent image from the above said media onto the final substrate. It is a still further object of the invention to provide a process for curing the radiation curable coating in the non-printed areas of the media. It is an object of the invention to provide a media that accepts a printed image, is radiation curable in the non-imaged area, and the imaged area is transferable to a final substrate. It is an object of the invention to provide a method for transferring an image to a heat- and/or pressure-sensitive final substrate without damage to the substrate. It is a further object of the invention to provide an image on a final substrate that is further cured with radiation.

DETAILED DESCRIPTION OF THE INVENTION

Figure 1:
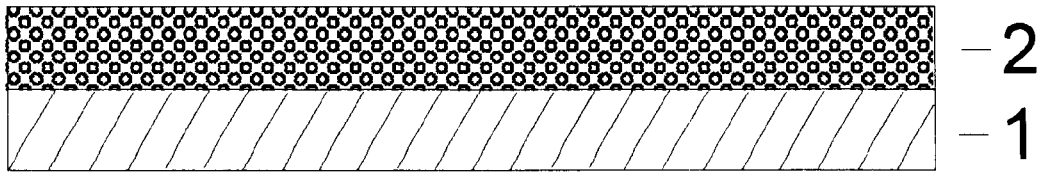
FIG. 1 is a drawing of the coated base sheet.
Figure 2:
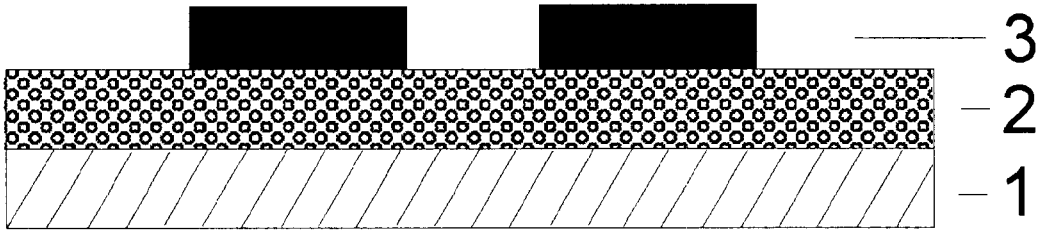
FIG. 2 is a drawing of the printed coated media according to the invention.
Figure 3:
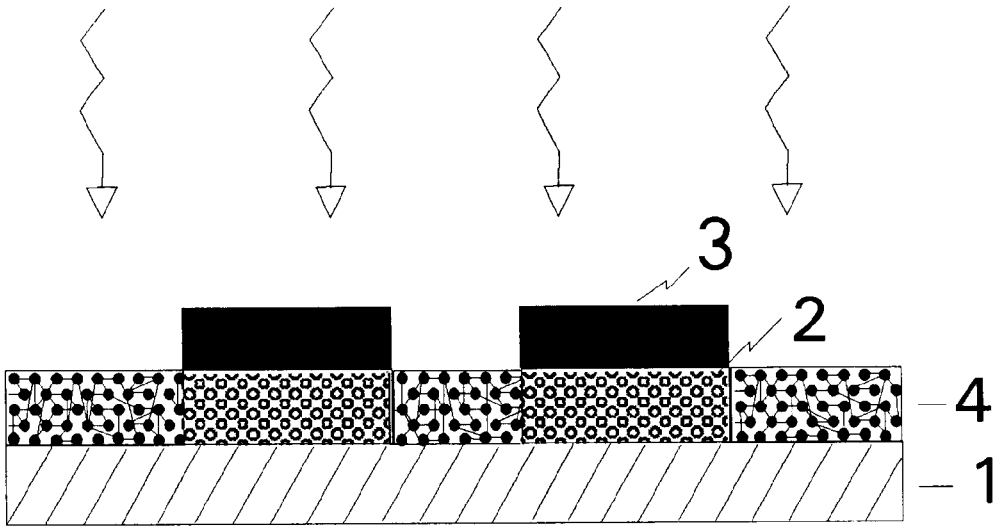
FIG. 3 is a drawing of the printed media following radiation cure.
Figure 4:
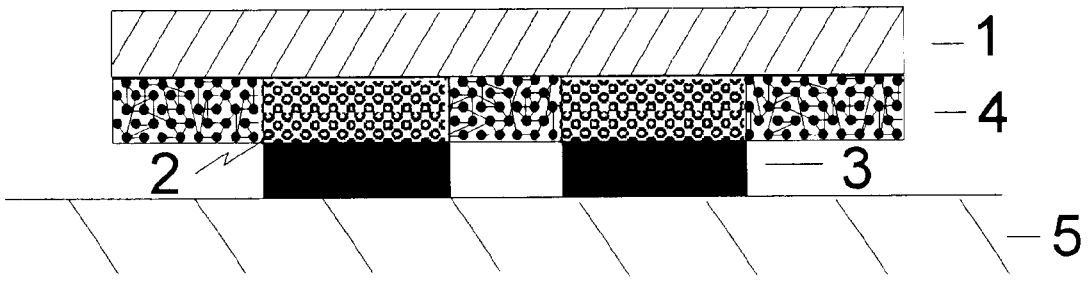
FIG. 4 is a drawing of the printed media in contact with the final substrate just prior to transfer to a final substrate.
Figure 5:
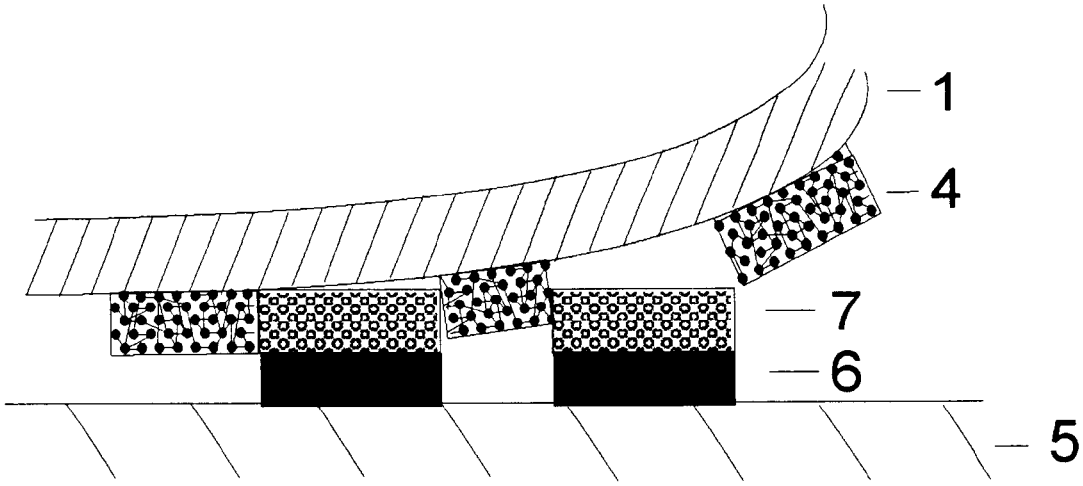
FIG. 5 is a drawing of a printed media and final substrate during transfer of an image.
Figure 6:
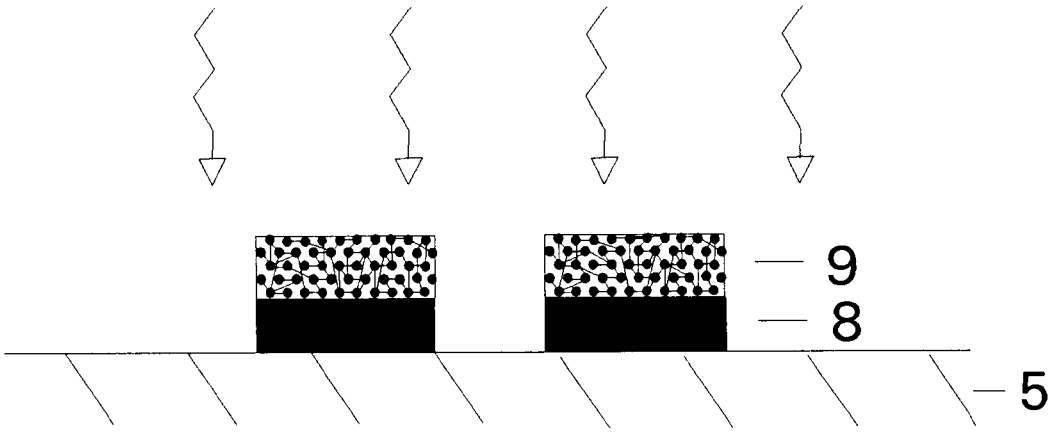
FIG. 6 is a drawing of a final substrate following transfer of an image and subsequent radiation cure.

A radiation curable resin is prepared, coated on a base sheet (1) and may be heated to form a radiation curable film coating (2), as shown in FIG. 1. The thus produced radiation curable media is then printed with an ink (3), as shown in FIG. 2. The printed media is then exposed to radiation and thus the non-imaged area on the printed media is cured (4), as shown in FIG. 3. The ink image (3) prevents curing of the UV curable coating (2) beneath the image. The printed image may then be transferred to a final substrate by the application of energy to the backside of the printed media. FIG. 4 illustrates the imaged media after radiation cure of the non-imaged area and placement in contact with the final substrate (5), prior to transfer of the image. After application of energy and/or pressure to the backside of the imaged media, the image (6) and non-cured coating under the image (7) resides on the final substrate (5) (FIG. 5), while the cured, non-imaged material of the media (4) remains on the base sheet (1). The transferred, non-cured radiation curable coating may be further cured (9) to more permanently fix the image (8) to the final substrate, as illustrated in FIG. 6.

A radiation curable resin is first prepared by mixing the ingredients necessary to produce a UV curable coating. These ingredients may include, but are not limited to, one or more photoinitiators, monomers and/or oligomers, plasticizers and other additives. Preferably the ingredients used to produce the radiation curable resin are solid at room temperature. If any of the materials used in the radiation curable resin are liquids, they may be rendered "solid" by absorption onto inert material, such as fumed silica, as is well known in the art. The radiation curable coating is produced in a manner usual for preparation of a UV curable powder coating, as described by Daly, et. al. in U.S. Pat. No. 6,017,593 and Biller, et. al. in U.S. Pat. No. 5,935,661, the teachings of which are incorporated herein by reference.

A typical method of preparation of the coating would be dry mixing the components, then melt blending in an extruder. The extruded compound is cooled and broken into chips, ground further to the final particle size, followed by classification, if necessary. The UV curable powders are then applied to a substrate, in this case a base sheet, to be coated. The typical method of application of powder coatings to a substrate involves electrostatic deposition. Other examples of methods of application include spraying, dipping, brushing and printing, including digital printing, solvent or aqueous coating. The base sheet material may be any supportive material. Examples include, but are not limited to, films of polyethylene terephthalate, cellulose acetate, polystyrene, polyamide, polycarbonate, polyimide, triacetate, polypropylene, aramide, and polyvinylchloride, cellophane, glassine paper, paper made of natural cellulosic fiber materials, copy, inkjet or laser paper, polyethylene-clad paper, opaque filled paper, condenser paper, metalized paper, and metal. The base sheet may contain various electroconductive granules such as carbon black or metal powder, or a coating of electroconductive material.

In a typical thermosetting powder coating, the coating would be heated to allow the powder to flow into a uniform film and begin a thermal curing reaction. In the present invention, however, UV radiation is required to begin the curing process. Relatively low heat (i.e., ≦110° C.) is, however, necessary to allow the powder to melt and flow into a uniform film. It may be useful to combine a solid plasticizer compound with the UV curable resin in order to lower the temperature necessary to allow the coating to flow. At this point, the UV curable media may be stored or used immediately for printing.

An alternative to powder coating the base sheet is to emulsify or solubilize the coating components. The diluent may be any non-reactive solvent, which is either removed by evaporation or remains in the formulation as a plasticizer. The emulsified or solubilized coating may be applied to the base sheet by any application method, such as digitally printing, or using any customary coating technique, such as air-knife, roll or blade coating.

The term "resin" will be used herein to mean the material coated on the substrate, prior to printing and curing or final polymerization reactions. The ingredients that make up the resin may include polymerizable monomers and/or oligomers or prepolymers. Examples include, but are not limited to, epoxies, such as butadiene oxide, diglycidyl ether of bisphenol A, 3,4-epoxycyclohexanecarboxylate, epoxy silicones, glycidol, octylene oxide, oxetane, phenyl glycidyl ether, polyglycidyl ether of novolak resin or phenolformaldehyde resole, propylene oxide, styrene oxide and vinylcyclohexene oxide; vinyl ethers, such as butanediol monovinyl ether, butyl vinyl ether, cyclohexane dimethanol monovinyl ether, cyclohexyl vinyl ether, diethyleneglycol divinyl ether, dodecyl vinyl ether, ethylene glycol monovinyl ether, 2-ethylhexyl vinyl ether, ethyl vinyl ether, octadecyl vinyl ether, poly-THF divinyl ether, propenyl ether of propylene carbonate, propyl vinyl ether and triethylene glycol methyl vinyl ether; cyclic ethers and thioethers, such as butylenes oxides, pentylene oxides, thiopropylenes and 1,3,5-trioxanes; unsaturated polyesters formed from di- or polyfunctional carboxylic acid (or their anhydrides), such as adipic acid, citraconic anhydride, cyclohexane dicarboxylic acid, dimeric methacrylic acid, fumaric acid, glutaric acid, maleic anhydride, malonic acid, orthophthalic acid, succinic acid, terephthalic acid, tetrahydrophthalic anhydride and trimellitic acid; and di- or polyhydric alcohols, such as bisphenol A, butanediol, diethylene glycol, dipropylene glycol, dodecanediol, ethylene glycol, hexanediol, neopentyl glycol, pentaerythritol, propanediol, triethylene glycol and trimethylol propane; polymers having acrylate or methacrylate groups, such as dimethacrylate terminated urethanes, triacrylates, such as trimethylolpropane triacrylate, diacrylates, such as 1,6-hexanediol diacrylate, acrylic acids, methacrylic acids, epoxy acrylates and epoxy methacrylates, phenoxyethyl methacrylate and tetrahydrofurfuryl acrylate or any combination of the above.

The resin formulation may include one or more photoinitiators. Examples of such include, but are not limited to, ferrocinium-types, such as $\eta^5$-2,4-(cyclopentadienyl){(1,2,3,4,5,6-η-)-(methylethyl)-benzene}-iron (II); indonium salts, such as bis-(dodecylphenyl)-indonium hexafluoroantimonate mixture of isomers; sulfonium-types, such as mixed triarylsulfonium hexafluoroantimonate salt and mixed triarylsulfonium hexafluorophosphate salt; benzoin; benzoin ethers, such as benzoin ethyl ether and benzoin isopropyl ether; benzyl ketals, such as benzyl dimethyl ketal; acyl phosphines, such as diphenyl-(2,4,6-trimethyl benzoyl)phosphine oxide; aryl ketones, such as 1-hydroxy cyclohexyl phenyl ketone (HCPK); bis($\gamma^5$-cyclopentadienyl) bis[2,6-difluoro-3-(1 H-pyrr-1-yl)phenyl]-titanium; 2-methyl-1-[4-(methylthio)phenyl]-2-morpholino-propan-1-one; 3,6-bis(2-methyl-2-morpholino-propanonyl)-9-butyl-carbazole; benzophenone, methyl 2-benzoylbenzoate; 2,4,6-trimethylbenzoyl-diphenyl-phosphine oxide; 4,4'-bis (dimethylamino)-benzophenone (Michler's ketone); benzil, ethyl 4-(dimethylamino)benzoate; 1-(4-dimethylaminophenyl)-ethanone; unsaturated amine acrylates and unsaturated copolymerizable tertiary amines, quinones, such as 9,10-anthraquinone; photosenzitizers including cumene hydroperoxide, anthracene and thioxanthone derivatives. The amount of photoinitiator may be from 0 to 20 wt. % of the resin coating; preferably 1 to 10 wt. %.

Rather than being included as part of the UV curable resin coating mixture, the photoinitiator may be applied to the UV curable media in a separate step. For example, the photoinitiator may be printed onto the UV curable media.

It may be useful to combine a solid plasticizer compound with the UV curable resin in order to lower the temperature necessary to allow the coating to flow. Preferably the coating will melt/flow below 150° C., most preferably below 110° C. Commonly used plasticizers include sulfonamides, toluene sulfonamides, benzoates, castor oil derivatives, epoxidized soya oil, or dicyclohexylphthalates. Other possible resin additives may include, but are not limited to, flow control agents, such as acrylic resins and silicone resins; dry flow additives, such as fumed silica and alumina oxide; fillers, such as calcium carbonate, synthetic silicates, barium sulfate, mica, clay, calcined kaolin and diatomaceous earth; anticratering agents; surfactants, such as acetylenic diol; light stabilizers, such as hindered amines and hindered phenols; degassing agents; sizing agents, such as starches or urea-formalin resin; binders, such as polyvinyl alcohol or casein; and waxes. When hydrogen abstraction type photoinitiators are used, such as benzophenone, xanthones or quinones, an aliphatic amine co-synergist may be added, such as triethylamine, dimethylethanol amine or methyl diethanol amine.

An image may be printed onto the media using any known printing method. For example, using conventional methods such as relief, planographic and intaglio printing, or digital methods such as inkjet, wax thermal, electrographic and phase change printing, or a combination of conventional and digital printing methods. The photoinitiator may also be applied in this manner. The image is printed in the reverse image of the desired final product. The inks used in the printing may be any known in the art, provided they perform the functions of providing an image and preventing penetration of radiation through the ink to the underlying curable media coating. Preferably the inks will be pigmented inks. The inks may also be dye-based if they are modified to include a material that functions to block the penetration of the radiation used in the curing step. Optionally, the image may be protected from radiation by application of a "UV blocking essentially colorless ink" over the printed image. In this way, a UV curable ink may be used in the invention. In addition, this will allow the use of colorants that do not inherently block the penetration of radiation through the image layer. The UV blocking material may optionally be incorporated into the ink. An example of a UV blocking material is an ultraviolet light absorber, such as benzotriazoles and hydroxyphenyltriazines. The inks will preferably also contain ingredients that help to permanently bind the transferred image to the final substrate. This is not a necessary requirement of the ink, however. It is possible, for example, for the image to be permanently fixed to the final substrate by radiation curing simultaneously with or following transfer to the final substrate. Examples of inks that aid in permanently binding the transferred image to the final substrate are described in U.S. Pat. Nos. 6,105,502 and 6,103,041. In these patents, blocked isocyanates and polyhydric alcohols are combined in inks in a non-activated state. The inks are then printed onto an intermediate media, still in a non-activated state. The printed images are then activated during heat transfer to a final substrate. During the transfer step the isocyanates become unblocked and available for crosslinking with the polyhydric alcohols and/or hydroxy functionality on the final substrate, i.e., cotton.

Another example of an ink that can be rendered permanent once transferred to a final substrate is given by application Ser. No. (09/322,737). Here, reactive dyes, along with an alkaline substance, a heat-activated printing additive and a wax-like binder are formulated for use with a wax thermal-type printing process. The inks are printed onto an intermediate media in a non-activated state, followed by heat transfer to a final substrate. During the heat transfer, the ink ingredients combine with the substrate, i.e., cotton, to form a permanent, transferred image. It is advantageous to have, for example, panels or monochrome ribbons of cyan, magenta, yellow and black. Additional panels or ribbons could be used, for example, an essentially colorless ribbon containing a material that absorbs UV radiation. An image could be formed, for example, by first printing a yellow ink onto the radiation curable media, followed by magenta, then cyan. Finally a "UV blocking colorless ink" could be printed on top as part of the present invention.

An additional function of using a UV cure resin with a relatively low melt/flow temperature is that in the non-cured state, the ingredients may perform the function of a "release agent". During the transfer of a printed image from the cured media, the non-cured area under the image is "softened" or melted to allow ease of release of the image from the media to the final substrate.

Following printing of an image onto the radiation curable media, the media is cured, preferably with ultraviolet radiation. Typical UV radiation is sufficiently energetic to initiate the curing chemical process when a suitable photoinitiator is present. An advantage of using UV radiation is that these wavelengths are not present in an appreciable amount in background visible radiation. An electron beam can also be used to induce reactions of monomers, oligomers and polymers. These electrons provide sufficient energy so that photoinitiators are not necessary. On the other hand, they are so energetic that the penetration of electrons is much greater than that of photons. For the purposes of this invention, "radiation", "UV" or "ultraviolet" radiation will be used to denote the method used to initiate polymerization. Preferred UV radiation is in the range of 200–400 nm.

A number of light sources are available for the UV curing process. Examples include medium pressure mercury lamps, low pressure mercury lamps, iron doped mercury lamps, gallium doped mercury vapor lamps, electrodeless lamps, xenon lamps, argon ion lasers and excimer lasers. The most common source is the medium pressure mercury lamp, which provides extremely intense output for fast cure times and relatively low energy consumption. Typical cure times range from 1 millisecond to 10 seconds. The most basic mercury bulb emits energy in both short and long wavelength ranges, but is stronger in the shorter wavelengths. Short wavelengths work on the surface, while longer wavelengths work more deeply in a coating.

Ideally, the UV curing system will be integrated with the method of application of the ink, i.e., the printing mechanism. This is not a requirement, however, and the printed UV curable media may be cured at a later time and/or location. After curing the printed media, the non-imaged area is then rendered "fixed" to the base sheet, while the image and area under the image remain in a non-cured state. At this point, the image is ready for transfer to a final substrate. The image on the media is placed in contact with the final substrate and energy and/or pressure is applied to the back side of the media to achieve transfer of the image to the final substrate. When heat is applied to effect transfer, only that degree which is necessary to allow the coating under the image to melt/flow and release the image and activate the ink, if necessary, is required. In this manner, relatively low temperatures and/or pressures may be used for transfer to heat- and/or pressure-sensitive final substrates, such as silk or wood. The final substrate may be any material, as long as it is capable of accepting the printed image and allowing essentially permanent attachment of the image. Suitable substrates include, but are not limited to, natural fibers, such as cotton, wool and silk, synthetic fibers, such as polyesters, nylon and "microfibers", blends of natural and synthetic fibers, wood, metal and plastic.

The radiation curable coating under the printed image may aid in permanently fixing the image to the final substrate. During the process of transferring the image to the final substrate the non-cured, radiation curable coating is softened or melted, allowing the image to be transferred. All or a portion of the radiation curable coating may be transferred along with the image. The image on the final substrate may then be cured with radiation to permanently fix the image to the final substrate. Optionally, mild heat may be applied prior to or simultaneous with the UV radiation to allow the UV curable coating to flow and form a smooth film upon curing.

The invention will be further clarified by some general formulas and examples of coatings and inks. It is not intended to exclude other compositions or formulations that would be obvious or ascertainable to one skilled in the art. Some general formulas are given first, followed by examples.

| General Media Coating Formulation: | |
|---|---|
| Monomers/oligomers | 40–95 wt. % |
| Photoinitiator | 0–10 |
| Plasticizer | 0–15 |
| Additives | 0–25 |
| General UV Cure Ink Formulation: | |
| UV cure resin (monomers/oligomers/photoinitiators) | 40–95 wt. % |
| Colorant (dyes/pigments) | 0–30 |
| Vehicle (carrier/wax/additives)* | 10–30 |
| General Thermal Cure Ink Formulation: | |
| Cross-linkable/thermal cure resin | 30–90 wt. % |
| Colorant | 0–30 |

-continued

| | |
|---|---|
| Vehicle | 10–30 |
| Catalyst | 0–5 |

*i.e., water, solvent, thermosetting resins, waxes, fillers, photostabilizers, emulsifiers, surfactants, dispersants, defoamers, leveling agents

EXAMPLE 1

The following ingredients were compounded as described above to form a powder coating, then electrostatically sprayed onto a cellulosic base sheet. The coated sheet was then heated for approximately 20 seconds at 100° C. to form the UV curable coated media.

| Epoxy/Vinyl Ether Type UV Curable Coating Formulation: | |
|---|---|
| Epoxy resin (bisphenol A epoxide) | 80 wt. % |
| Vinyl ether (aromatic urethane divinyl ether) | 10 |
| Photoinitiator (benzil dimethyl ketal) | 4 |
| Plasticizer (soya oil) | 3 |
| Flow agent (acrylic flow aid) | 3 |

An image was then printed onto the media using a Seiko ColorPoint wax thermal printer using CMYK inks made according to the following formulation:

| Thermally Crosslinkable Ink: | |
|---|---|
| Polyhydric alcohol | 44 wt. % |
| Blocked polyisocyanate | 30 |
| Pigment | 15 |
| Vehicle (wax/EVA) | 10 |
| Catalyst | 1% |

The printed media was exposed to UV radiation to cure the non-imaged area. The media was then placed in contact with silk fabric and the image transferred by heating at 120° C. for 20 seconds at 40 psi to permanently bind the image to the fabric.

EXAMPLE 2

The same coated media as described in Example 1 was printed with an ink of the following formulation using a Seiko ColorPoint wax thermal printer:

| Wax-based OEM Pigmented Ink: | |
|---|---|
| Wax | 70 wt. % |
| Pigment | 20 |
| Binder (EVA) | 10 |

The printed media was exposed to UV radiation to cure the non-imaged area. The media was then placed in contact with a ceramic tile and the image transferred by heating at 130° C. for 30 seconds at 40 psi. The imaged tile was then immediately exposed to UV radiation to permanently fix the image to the substrate.

EXAMPLE 3

The following ingredients were combined to form an aqueous emulsion and coated onto a cellulosic base sheet. The coated sheet was then heated for approximately 20 seconds at 100° C. to form the UV curable coated media.

| Polyester/Vinyl Ether Type UV Curable Coating Formulation: | |
|---|---|
| Unsaturated polyester resin (i.e., Uracross P 3125; DSM N.V.) | 70 wt. % |
| Vinyl ether (i.e., Uracross P 3307; DSM N.V.) | 20 |
| Plasticizer (benzoate ester) | 4 |
| Photoinitiator (HCPK) | 3 |
| Flow agent (Modaflow Powder III; Solutia) | 3 |

An image was then printed onto the media using a Seiko ColorPoint wax thermal printer using CMYK inks made according to the following formulation:

| Reactive dye-Containing Ink: | |
|---|---|
| Vehicle (carnauba wax) | 50 wt. % |
| Heat-activated printing additive (urea) | 25 |
| Reactive dye (Reactive Red 120) | 15 |
| Alkali (sodium bicarbonate) | 5 |
| Binder (EVA) | 5 |

The following colorless ink was then printed over the entire CMYK printed image:

| UV Blocking Colorless Ink: | |
|---|---|
| Vehicle (paraffin wax) | 70 wt. % |
| UVA (benzotriazole) | 30 |

The printed media was exposed to UV radiation to cure the non-imaged area. The media was then placed in contact with cotton fabric and the image transferred by heating at 130° C. for 30 seconds at 40 psi. The final imaged substrate was then exposed to UV radiation to further fix the image to the substrate.

EXAMPLE 4

A laser printing paper was coated as described in Example 3 and heated for approximately 20 seconds at 100° C. to form the UV curable media. An image was then printed onto the UV curable media using a Tektronix Phaser 780 laser printer using a toner with the following formulation:

| Pigmented OEM Toner: | |
|---|---|
| Polyester resin | 92 wt. % |
| Pigment | 5 |
| Charge control agent | 3 |
| Silica | 0.2 |

The printed media was exposed to UV radiation to cure the non-imaged area. The media was then placed in contact with a wooden plaque and the image transferred by heating at 150° C. for 30 seconds at 40 psi. The imaged plaque was then immediately exposed to UV radiation to permanently fix the image to the substrate.

What is claimed is:

1. A method of printing, comprising the steps of:

printing an image layer on a media, wherein said media is coated with a radiation curable coating, and wherein said image layer is printed over said radiation curable coating, and wherein said image layer does not completely cover said radiation curable coating;

exposing said media to radiation, wherein a portion of said radiation curable coating which is not covered by said image layer is cured, and a portion of said radiation curable coating which is covered by said image layer is not cured; and transferring the image layer and said portion of said radiation curable coating which is covered by said image layer from said media to a final substrate, wherein said portion of said radiation curable coating that is not covered by said image layer does not transfer from said media to said final substrate.

2. A method of printing as described in claim 1, wherein said radiation curable coating is ultraviolet radiation curable.

3. A method of printing as described in claim 2, wherein said ultraviolet radiation is in the range of 200–400 nm.

4. A method of printing as described in claim 1, wherein said image layer and said portion of said radiation curable coating which is covered by said image layer are transferred to said final substrate by the application of heat.

5. A method of printing as described in claim 4, further comprising the step of exposing said image layer and said portion of said radiation curable coating which is covered by said image layer to radiation after transfer to said final substrate, wherein said radiation curable coating which is transferred is cured by the radiation.

6. A method of printing as described in claim 1, wherein said image layer is formed by an ink.

7. A method of printing as described in claim 6, wherein said ink comprises pigments.

8. A method of printing as described in claim 6, wherein said ink comprises a blocked isocyanate.

9. A method of printing as described in claim 1, further comprising the step of exposing said image layer and said portion of said radiation curable coating which is covered by said image layer to radiation after transfer to said final substrate, wherein said radiation curable coating which is transferred is cured by the radiation.

10. A method of printing as described in claim 1, wherein said radiation curable coating is applied to the media by means of a digital printing device.

* * * * *